United States Patent [19]

Provence et al.

[11] Patent Number: 4,993,741

[45] Date of Patent: Feb. 19, 1991

[54] LATERAL GUIDANCE DEVICE FOR A CROSS-COUNTRY SKI

[75] Inventors: Marc Provence, Thorens Les Glieres; Gerard Graillat, Annecy, both of France

[73] Assignee: Salomon S.A., Annecy Cedex, France

[21] Appl. No.: 434,990

[22] Filed: Nov. 13, 1989

[30] Foreign Application Priority Data

Nov. 14, 1988 [FR] France ..... 88 14773

[51] Int. Cl.[5] ..... A63C 9/20

[52] U.S. Cl. ..... 280/615

[58] Field of Search ..... 280/607, 609, 614, 615, 280/636

[56] References Cited

U.S. PATENT DOCUMENTS 4,312,141 1/1982 Mayer et al. ..... 280/615 X
4,789,178 12/1988 Olivieri ..... 280/615

FOREIGN PATENT DOCUMENTS 61783 10/1918 Austria .
0278859 8/1988 European Pat. Off. .
0283331 9/1988 European Pat. Off. .
2807279 8/1979 Fed. Rep. of Germany .
2610526 8/1988 France .

*Primary Examiner*—Charles A. Marmor
*Assistant Examiner*—Michael Mar
*Attorney, Agent, or Firm*—Sandler, Greenblum & Bernstein

[57] ABSTRACT

A lateral guidance device for a cross-country ski shoe or boot in the form of a rib secured to a cross-country ski. The guidance rib includes cross pieces having ends that are spaced above the upper surface of the ski to permit any water in the guidance rib to be evacuated. Additonal cross pieces permit flexibility of the guidance rib and notches allow the guidance rib to be broken to a predetermined size.

31 Claims, 2 Drawing Sheets

LATERAL GUIDANCE DEVICE FOR A CROSS-COUNTRY SKI

BACKGROUND OF THE INVENTION

1. Field of the Invention

The present invention relates to a lateral guidance device for a cross-country ski shoe or boot in which the cross-country ski, thereby allowing the heel to move at least vertically.

2. Description of Background and Relevant Information

Various devices are known which make it possible to ensure the lateral guidance of a cross-country ski shoe or boot with respect to the ski on which it is mounted. Some of these devices include a solid or hollow section member which is connected to the upper surface of the ski and includes a longitudinal guidance rib in a central portion. This rib cooperates with a longitudinal groove of a complementary shape which is provided in the sole of the cross-country ski shoe or boot, so as to ensure the lateral guidance of the shoe as the shoe is lowered and becomes flat on the ski. The longitudinal guidance rib of the section member can be solid or hollow and opens downwardly towards the upper surface of the ski, and includes two lateral coplanar wings which extend from the outside of the section member and are affixed to the upper surface of the ski to support the section member.

SUMMARY OF THE INVENTION

The present invention relates to improvements in such a lateral guidance device and facilitates the flow of water, which may possibly be present within the guidance section member, and directs the water towards the exterior of the section member in the longitudinal direction and, optionally, also in the transverse direction.

The lateral guidance device of the present invention guides a ski shoe or boot which is affixed at its front end to a cross-country ski whereby a heel of the ski shoe or boot is free to move in at least a vertical direction. The device includes a section member which is adapted to be mounted on the ski and includes a longitudinal guidance rib adapted to cooperate with a longitudinal groove with a complementary shape provided in a sole of the shoe or boot, to laterally guide the shoe or boot while it is lowered towards the ski. The longitudinal guidance rib includes a central part and two lateral support parts extending therefrom for resting on the upper surface of the ski. The lower surface of the central part is raised with respect to the lower surfaces of the two lateral support parts to provide a free space between the lower surface of the central part and the upper surface of the ski to permit the longitudinal flow of any water within the section member.

The guidance rib is hollow and open in the longitudinal direction of the ski, and includes two lateral walls and cross pieces for rigidification extending between the two lateral walls of the guidance rib. The lower edges of the cross pieces are slightly raised with respect to the lower surfaces of the two lateral support parts. The section member and cross pieces may be made of a single piece of molded plastic material. The cross pieces may be inclined from bottom to top and from rear to front of the device, or they may be inclined from bottom to top and from front to rear of the device. Alternatively, the cross pieces may be substantially perpendicular to the ski.

According to another aspect of the invention, the guidance rib includes an upper wall and at least one additional cross piece, which each include two substantially parallel transverse walls extending towards the ski from the upper wall. The lower edges of the transverse walls are connected by a bottom wall, whereby the upper wall and the two lateral walls are open between the two parallel transverse walls. The additional cross pieces may be substantially parallel to the cross pieces, or they may have a different orientation than the cross pieces. The lower surface of the bottom wall of each additional cross piece is spaced above the upper surface of the ski.

A transverse notch is located in the lower surface of the bottom wall and has a V-shaped cross-section with the point of the V directed upwardly, whereby a zone of less thickness and less resistance is formed to provide a break portion. The notch extends transversely across the two lateral support parts to form a zone of less resistance and channels for the evacuation of water.

The two lateral support parts comprise lateral coplanar wings extending in opposite directions from the central part of the guidance rib.

The invention is also directed to a cross-country ski for use with a ski shoe or boot so that the heel of the ski shoe or boot is free to move in at least a vertical direction, the sole of the ski shoe or boot having a longitudinal groove. The cross-country ski includes the combination of a ski body having an upper surface and longitudinal and lateral directions; a guidance rib having longitudinal and lateral axes and upper and lower surfaces, the longitudinal axis of the guidance rib extending in the longitudinal direction of the ski; and two lateral support parts, each extending along the lateral axis of the guidance rib to the upper surface of the ski, wherein the lower surface of the guidance rib is raised with respect to the upper surface of the ski to provide a free space between the guidance rib and the ski to permit the longitudinal flow of any water within the guidance rib.

The guidance rib includes two lateral walls and at least one cross piece extending between the two lateral walls, lower ends of the cross piece being spaced above the upper surface of the ski.

The invention is also directed to the guidance device itself for use with a cross-country ski to provide guidance for a ski shoe or boot. The guidance rib includes an upper wall, a lower surface, two lateral walls, and two lateral support parts, having a lower surface, each lateral support part respectively extending from one of the two lateral walls and adapted to secure the device to a cross-country ski. The lower surface of the guidance rib is recessed with respect to the lower surface of the lateral support parts to permit the flow of any water within the guidance rib when the guidance rib is secured to a ski. The guidance rib includes at least one cross piece extending between the two lateral walls, lower ends of each cross piece being recessed with respect to the lower surface of the lateral support parts.

BRIEF DESCRIPTION OF THE DRAWINGS

The invention is further explained in the description which follows with reference to the drawings illustrating, by way of non-limiting examples, embodiments of the invention wherein.

DETAILED DESCRIPTION OF THE PREFERRED EMBODIMENTS

Figure 1:
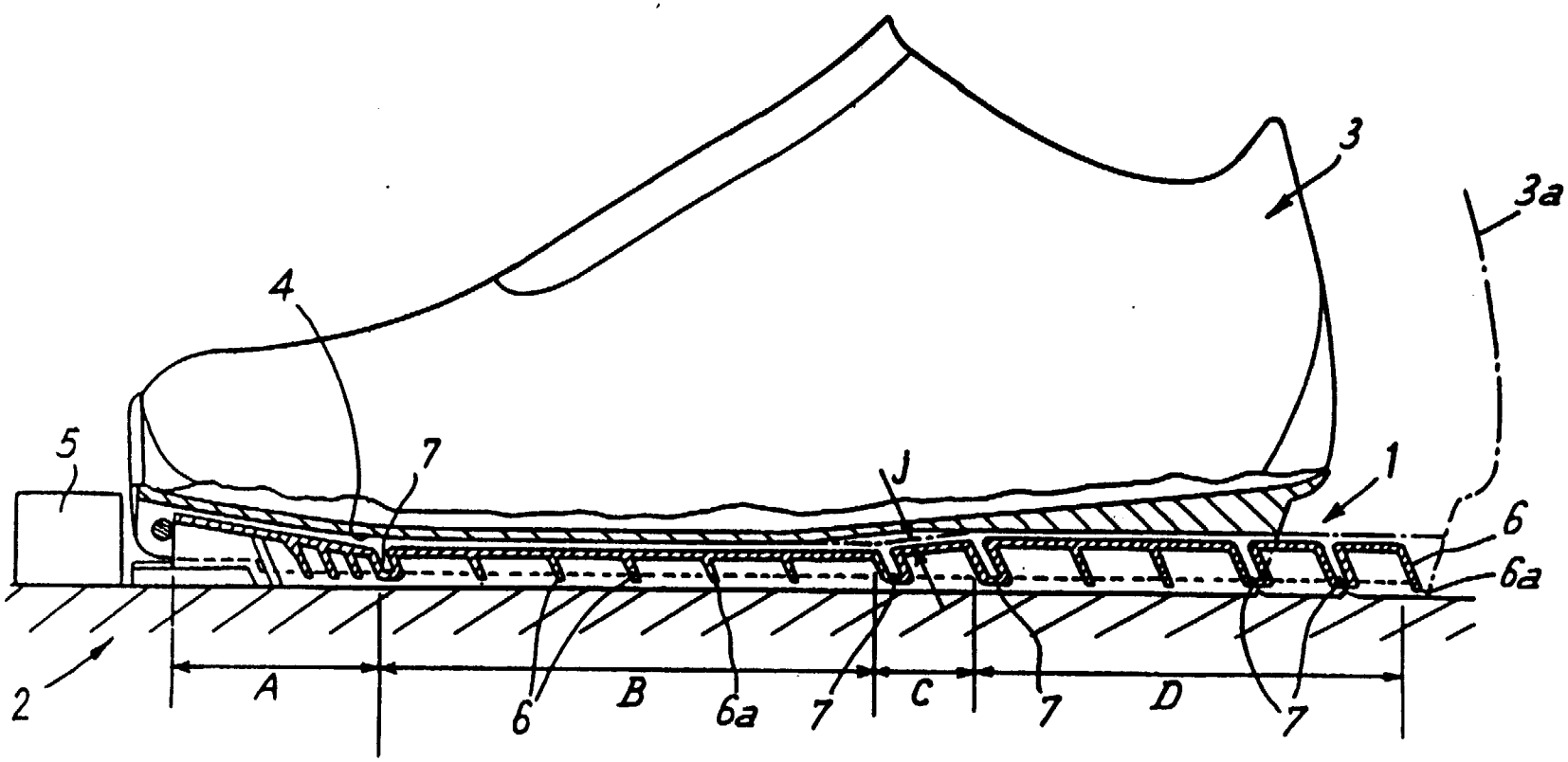
FIG. 1 is a schematic vertical and longitudinal sectional view of a lateral guidance device for a shoe or boot connected to a cross-country ski according to the invention.

The lateral guidance device of the invention is used with a ski shoe or boot which is affixed at its front end to a ski, such as a cross-country ski, and whose heel is free to move at least vertically. The lateral guidance device includes a section member connected to the ski which includes a longitudinal guidance rib which cooperates with a longitudinal groove with a complementary shape provided in the sole of the shoe or boot, so as to ensure the lateral guidance of the shoe or boot as it lowers to become flat on the ski. The longitudinal guidance rib is located at the central part of the section member and the section member includes two lateral parts which rest on the upper surface of the ski. The lower surface of the central part of the section member, which constitutes the central guidance rib, is raised with respect to the lower surfaces of the two lateral support parts of the section member which rest on the upper surface of the ski so as to provide a free space between the lower surface of the central rib and the upper surface of the ski to permit the longitudinal flow of any water which may be within the section member.

The longitudinal guidance rib constituting the central part of the section member can be solid or hollow. When it is hollow, the central guidance rib includes cross pieces for rigidity which extend between the two lateral and longitudinal walls and whose respective lower edges are slightly raised with respect to the lower surfaces of the two lateral support parts of the section member.

According to a preferred embodiment of the invention, the section member has at least one transverse cutout extending completely through the longitudinal guidance rib and opening into the upper and lateral surfaces thereof. Each transverse cutout includes a zone for providing the guidance section member with great flexibility or pliability in the longitudinal direction. This increased flexibility permits the easy adaptation of the longitudinal guidance rib to the curve of the cross-country ski and it likewise facilitates the gluing or the fastening by any other means of the section member to the upper surface of the ski. Moreover, the bottom wall of all or certain transverse cutouts can preferably have a zone of lesser resistance which extends transversely to facilitate the breaking of the section member at those locations. This arrangement makes it possible to easily adapt the guidance section member to shoes or boots of different sizes by shortening the length of the guidance rib.

The lateral guidance device according to the invention, is a section member 1, which may be solid or hollow, and is preferably made of plastic material. Section member 1 is affixed by any appropriate means to upper surface 2*a* of cross-country ski 2. Section member 1 is adapted to ensure the lateral guidance of a cross-country ski shoe or boot 3 during cross-country skiing. The sole of shoe or boot 3 includes a longitudinal groove 4, which cooperates with section member 1 by nesting substantially tightly thereon. Shoe or boot 3 is affixed in the usual manner to ski 2, at its front end, by means of binding 5 which is mounted on the ski, schematically shown in FIG. 1, allowing the heel of shoe or boot 3 to move freely in at least the vertically direction.

In the embodiment shown in FIG. 1 section member 1, which constitutes the lateral guidance device has, in its downwardly open central hollow part, longitudinal guidance rib 1*a*, having a polygonal or curved shaped cross-section, which includes at its lower part two lateral and horizontal opposed coplanar wings 1*b*, 1*c*, extending laterally and in contact with the upper surface of ski 2. In the embodiment of the invention shown in the drawings, rib 1*a* has a cross-section generally in the shape of an isosceles trapezoid and includes an upper horizontal wall 1*d*, defining the small side of the transverse trapezoidal section, and two inclined lateral walls 1*e*, 1*f* connected to lower horizontal wings 1*b*, 1*c*. As a result, the assembly of section member 1 which constitutes the lateral guidance device is generally symmetrical with respect to the longitudinal and vertical plane of symmetry P of ski 2 and it substantially has a transverse section in the shape of an omega. However, this construction is not limiting and section member 1 could have a cross-section with a polygonal or curved shape, and may or may not be symmetrical with respect to plane P. Further, section member 1 could even have lateral support parts 1*b*, 1*c* on the ski with different shapes.

The height of central guidance rib 1*a* can be constant over the entire length of section member 1 or even, according to a particularly advantageous arrangement as shown in FIG. 1, the height of guidance rib successively includes, from front to rear, a first section A with a height decreasing from the front to the rear and a length substantially corresponding to the support zone of the toes of the foot; a second section B of low constant height which cooperates with the zone of the sole and substantially corresponds to the front portion of the metatarsus; a third section C of increasing height; and a fourth rear section D of constant height which extends as far as the rear end of the heel of the shoe.

According to the invention, section member 1 has, within its central part, which constitutes central guidance rib 1*a*, a solid cross piece 6 for rigidification which extends between the two lateral and longitudinal walls 1*e*, 1*f* of rib 1*a*, whose lower edges 6*a* are slightly raised with respect to the lower support surfaces of two coplanar lateral wings 1*b*, 1*c* of section member 1 so as to provide free spaces between edges 6*a* and the upper surface 2*a* of ski 2 to permit the longitudinal flow of any water within the section member. A cross piece 6 is also provided at the rear end of the section member and its lower edge 6*a* defines an opening for the exit of water. Preferably, section member 1 is made of a single piece of molded plastic material and the rigidification cross pieces 6 are molded with the rest of section member 1. These cross pieces 6 can be inclined from bottom to top and from rear to front, as is shown in FIGS. 1 and 2, or alternatively from front to rear, or they can be vertical, i.e., perpendicular to ski 2.

Guidance section member 1 can also have, in appropriate locations distributed over its length, additional cross pieces 7 which are thicker but hollow so that each defines a transverse cutout 8 which extends completely through central guidance rib 1*a* and opens into the upper horizontal wall 1*d* and in the two lateral walls 1*e*, 1*f* of rib 1*a*. Each cutout 8 is thus defined by two parallel transverse walls 7*a*, 7*b* of the hollow cross piece 7 which are each connected to upper wall 1*d* and to lateral walls 1e, 1f and which are connected to each other along their lower edges by horizontal bottom wall 7c, as can best be seen in FIG. 2. Each transverse cutout 8 thus gives guidance section member 1 a predetermined longitudinal flexibility which permits easy adaptation to the curve of the ski and thereby facilitates its affixation to the upper surface of ski 2.

Figure 2:
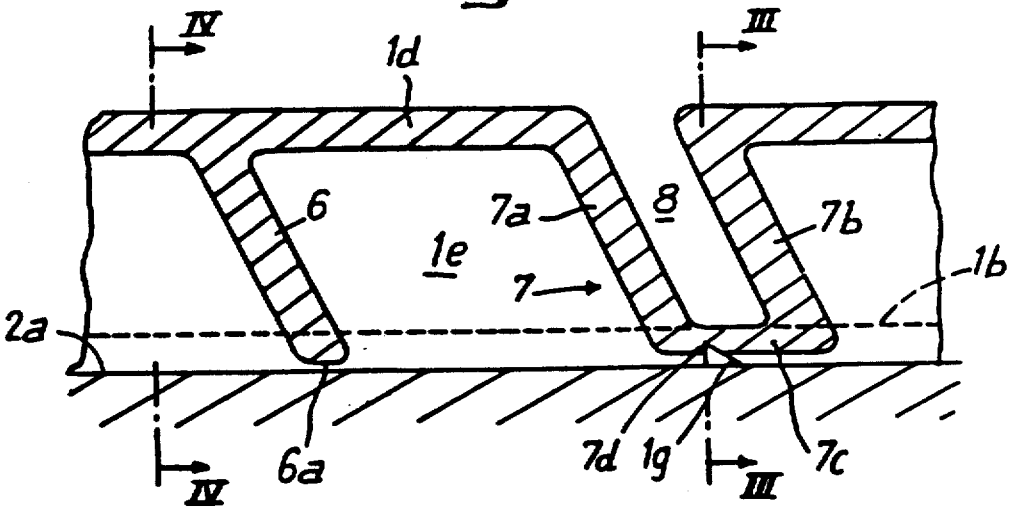
FIG. 2 is a enlarged partial longitudinal sectional view of the guidance device of FIG. 1.
Figure 3:
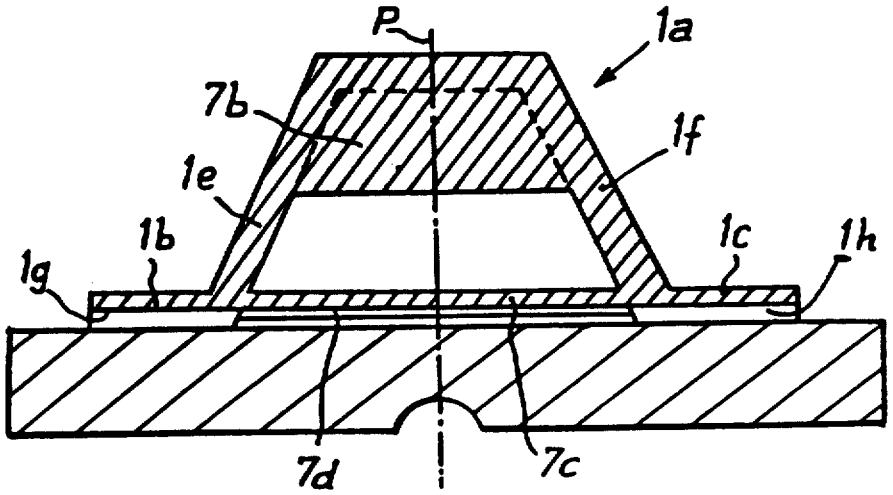
FIG. 3 is a transverse sectional view taken along line III—III of FIG. 2.
Figure 4:
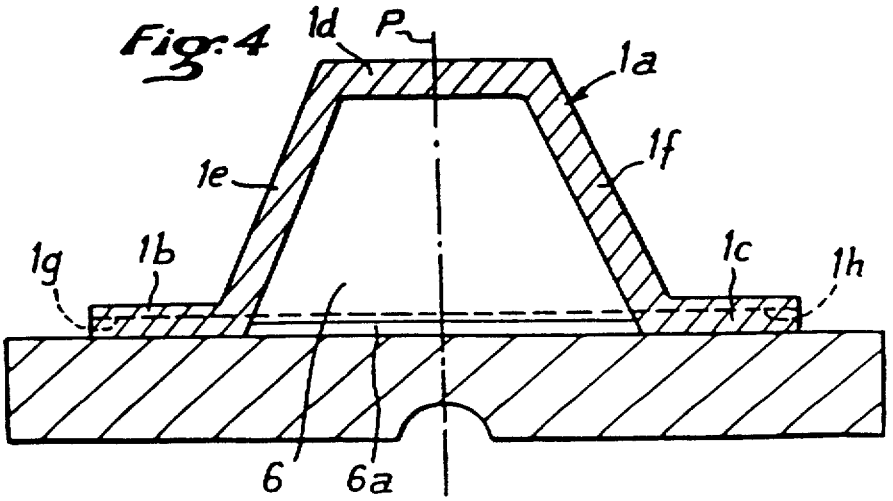
FIG. 4 is a transverse sectional view taken along line IV—IV of FIG. 2.

Cross pieces 7 which include cutouts 8 can be parallel to the rigidification cross pieces 6, as is shown in FIGS. 1 and 2, or alternatively can have a different orientation with respect thereto.

The lower surface of the bottom wall 7c of each hollow cross piece 7 is located a short distance above upper surface 2a of ski 2 so as to define a passage for the longitudinal flow of water. This space can be obtained by the thickness of bottom wall 7c being slightly less than the thickness of wings 1b, 1c, if the upper surface of the bottom wall 7c is even with the upper surfaces of the two wings 1b, 1c.

The bottom wall 7c of hollow cross piece 7 can include in its lower surface, a transverse notch 7d having a V-shaped cross-section with the point directed upwardly. This forms a zone of lesser thickness between the bottom of notch 7d and the upper surface of the bottom wall 7c and, consequently, a zone of lesser resistance for forming an initial break portion. The lower notch 7d of the bottom wall 7c also extends transversely in the two lateral wings 1b, 1c, forming transverse notches 1g, 1h, which are provided in the lower surfaces r,f the two wings and which open into the longitudinal edges thereof. Lower notches 1g, 1h of wings 1b, 1c constitute zones of lesser resistance and also channels for evacuation of water towards the exterior of hollow guidance section member 1. Moreover, notches 1g, 1h also contribute jointly with the lower notch 7d of the bottom wall 7c, to facilitate transverse breaking of guidance section member 1, to permit its length to be shortened to adapt it to the particular length of the shoe or boot. As shown in FIG. 1, section member 1 comprises in its rear part, two hollow cross pieces 7 which make it possible to optionally shorten section member 1 to adapt it to a shoe or boot of small size 3 or large size 3a.

Although the invention has been described with reference to particular means, materials and embodiments, it is to be understood that the invention is not limited to the particulars disclosed and extends to all equivalents within the scope of the claims.

We claim:

1. A device for lateral guidance of a ski shoe or boot which is affixed at its front end to a cross-country ski having an upper surface has been inserted whereby a heel of the ski shoe or boot is free to move in at least a vertical direction, said device comprising a section member adapted to be mounted on the ski, said section member including a longitudinal guidance rib adapted to cooperate with a longitudinal groove with a complementary shape provided in a sole of the shoe or boot, to laterally guide the shoe or boot while it is lowered towards the ski, the longitudinal guidance rib including a central part and two lateral support parts extending therefrom, said lateral support parts engaging the upper surface of the ski, the lower surface of said central part being raised with respect to the lower surface of said two lateral support parts to provide a free space between the lower surface of the central part and the upper surface of the ski to permit the flow of any water within said section member, wherein said guidance rib comprises hollow portions, said guidance rib including two lateral walls, said guidance rib including cross pieces for rigidification extending between said two lateral walls of said guidance rib, the lower edges of said cross pieces being slightly raised with respect to the lower surfaces of said two lateral support parts.

2. The device according to claim 1, wherein said section member and cross pieces are made of a single piece of molded plastic material.

3. The device according to claim 1, wherein said cross pieces are inclined from bottom to top and from rear to front of the device.

4. The device according to claim 1, wherein said cross pieces are inclined from bottom to top and from front to rear of the device.

5. The device according to claim 1, wherein said cross pieces are substantially perpendicular to the ski.

6. The device according to claim 1, wherein said guidance rib includes an upper wall and further comprises at least one additional cross piece, each said additional cross piece including two substantially parallel transverse walls extending towards the ski from said upper wall, lower edges of said transverse walls being connected by a bottom wall, whereby said upper wall and said two lateral walls are open between said two parallel transverse walls.

7. The device according to claim 6, wherein said additional cross pieces are substantially parallel to said cross pieces.

8. The device according to claim 6, wherein said additional cross pieces have a different orientation than said cross pieces.

9. The device according to claim 6, wherein the lower surface of the bottom wall of each additional cross piece is spaced above the upper surface of the ski.

10. The device according to claim 6, comprising a transverse notch in the lower surface of said bottom wall, said transverse notch having a V-shaped cross-section with the point of the V directed upwardly, whereby a zone of less thickness and less resistance is formed to provide a break portion.

11. The device according to claim 10, wherein said notch extends transversely across said two lateral support parts to form a zone of less resistance and channels for the evacuation of water.

12. The device according to claim 1, wherein said two lateral support parts comprise lateral coplanar wings extending in opposite directions from said central part of said guidance rib.

13. A cross-country ski for the use with a ski shoe or boot so that the heel of the ski shoe or boot is free to move in at least a vertical direction, the sole of the ski shoe or boot having a longitudinal groove, said cross-country ski comprising:

(a) a ski body having an upper surface and longitudinal and lateral directions;

(b) a guidance rib having longitudinal and lateral axes and upper and lower surfaces, the longitudinal axis of said guidance rib extending in said longitudinal direction of said ski;

(c) two lateral support parts, each extending along the lateral axis of said guidance rib and engaging the upper surface of the ski, wherein the lower surface of said guidance rib is raised with respect to the upper surface of said ski to provide a free space between said guidance rib and said ski to permit the longitudinal flow of any water within said guidance; and (d) said guidance rib including two lateral walls and at least one cross piece extending between said two lateral walls, lower ends of said cross piece being spaced above said upper surface of said ski.

14. The cross-country ski according to claim 13, wherein said guidance rib and said at least one cross piece are made of a single piece of molded plastic material.

15. The cross-country ski according to claim 13, wherein said at least one cross piece is inclined with respect to the upper surface of said ski.

16. The cross-country ski according to claim 13, wherein said at least one cross piece is substantially perpendicular to the upper surface of said ski.

17. The cross-country ski according to claim 13, further comprising at least one additional cross piece, each said additional cross piece including two substantially parallel transverse walls extending towards said ski from said upper surface of said guidance rib, lower edges of said transverse walls being connected by a bottom wall, whereby said upper surface of said guidance rib and said two lateral walls are open between said two parallel transverse walls.

18. The cross-country ski according to claim 17, wherein said at least one additional cross piece is substantially parallel to said at least one cross piece.

19. The cross-country ski according to claim 17, wherein the lower surface of said bottom wall of each additional cross piece is spaced above said upper surface of said ski.

20. The cross-country ski according to claim 17, comprising a transverse notch in the lower surface of said bottom wall, said transverse notch having a V-shaped cross-section, whereby a zone of less thickness and less resistance is formed to provide a break portion.

21. The cross-country ski according to claim 20, wherein said notch extends transversely across said two lateral support parts to form a zone of less resistance and channels for the evacuation of water.

22. The cross-country ski according to claim 13, wherein said two lateral support parts comprise lateral coplanar wings respectively extending in opposite directions from said guidance rib.

23. A device for use with a cross-country ski having an upper surface to provide guidance for a ski shoe or boot, said device comprising:

(a) a guidance rib having an upper wall, a lower surface, and two lateral walls;

(b) two lateral support parts, each having a lower surface, each lateral support part respectively extending from said two lateral walls, said two lateral support parts adapted to engage the upper surface of a cross-country ski for securement thereto said lower surface of said guidance rib being recessed with respect to said lower surface of said lateral support parts to permit the flow of any water within said guidance rib when said guidance rib is secured to a ski; and (c) said guidance rib including at least one cross piece extending between said two lateral walls, lower end of each said cross piece being recessed with respect to said lower surface of said lateral support parts.

24. The device according to claim 23, wherein said guidance rib and said at least ore cross piece are made of a single piece of molded plastic material.

25. The device according to claim 23, further comprising at least one additional cross piece, each said additional cross piece including two substantially parallel transverse walls extending from said upper wall of said guidance rib, lower edges of said transverse walls being connected by a bottom wall, whereby said upper wall and said two lateral walls are open between said two transverse walls.

26. The device according to claim 25, wherein said at least one additional cross piece is substantially parallel to said at least one cross piece.

27. The device according to claim 25, wherein the lower surface of said bottom wall of each additional cross piece is recessed with respect to said lower surface of said lateral support parts.

28. The device according to claim 25, comprising a transverse notch in the lower surface of said bottom wall, whereby a zone of less thickness and less resistance is formed to provide a break portion.

29. The device according to claim 28, wherein said notch is V-shaped.

30. The device according to claim 28, wherein said notch extends transversely across said two lateral support parts to form a zone of less resistance.

31. The device according to claim 23, wherein said two lateral support parts comprise lateral coplanar wings respectively extending in opposite directions from said guidance rib.

* * * * *

UNITED STATES PATENT AND TRADEMARK OFFICE

CERTIFICATE OF CORRECTION

PATENT NO. : 4,993,741

DATED : February 19, 1991

INVENTOR(S) : Marc PROVENCE et al.

It is certified that error appears in the above-identified patent and that said Letters Patent is hereby corrected as shown below:

At column 1, line 9, after "which the" insert ---shoe or boot is pivoted at its front end to a ski, such as a---.

At column 5, line 51 of the printed patent, after "surface" delete ---has been inserted---.

At column 8, line 19 (claim 24, line 2), change "ore" to ---one---.

Signed and Sealed this

Ninth Day of March, 1993

*Attest:*

*Attesting Officer*

STEPHEN G. KUNIN

*Acting Commissioner of Patents and Trademarks*